United States Patent [19]

Tausig

[11] 4,319,372

[45] Mar. 16, 1982

[54] SUBMARINE RESCUE CABLE REEL

[75] Inventor: Wayne R. Tausig, Oxnard, Calif.

[73] Assignee: The United States of America as represented by the Secretary of the Navy, Washington, D.C.

[21] Appl. No.: 137,681

[22] Filed: Apr. 7, 1980

[51] Int. Cl.[3] ..... B63B 21/52

[52] U.S. Cl. ..... 441/25; 114/331; 192/93 C; 242/99; 441/26; 441/29

[58] Field of Search ..... 9/8 R, 9; 440/90, 30; 114/323-329, 331; 192/93 C; 242/99; 403/324, 2

[56] References Cited

U.S. PATENT DOCUMENTS

| | | | |
|---|---|---|---|
| 1,249,486 | 12/1917 | Polachek | 9/9 |
| 1,416,336 | 5/1922 | Czeperko | 9/9 |
| 1,461,697 | 7/1923 | Coughlan | 440/30 |
| 2,508,558 | 5/1950 | Wolff | 192/93 C |
| 2,819,476 | 1/1958 | Dodge | 9/8 R |
| 2,830,309 | 4/1958 | Lawson | 9/9 |
| 3,035,285 | 5/1962 | Squires, Jr. | 9/9 |
| 3,066,324 | 12/1962 | Snyder et al. | 114/331 X |

FOREIGN PATENT DOCUMENTS

| | | | |
|---|---|---|---|
| 2032857 | 1/1972 | Fed. Rep. of Germany | 440/90 |

*Primary Examiner*—Sherman D. Basinger

*Attorney, Agent, or Firm*—Robert F. Beers; J. M. St. Amand; W. C. Daubenspeck

[57] ABSTRACT

Apparatus for delivering a heavy cable such as a rescue cable from the ocean's surface to an extended depth for attachment to an object such as a stranded submarine and, after attachment of the free end of the cable to the object, delivering the cable to the ocean's surface. A syntactic foam float provides positive buoyancy for a frame assembly which supports a cable reel holding the heavy cable. Releasable ballasts are included to provide an initial overall buoyancy of a small negative value during the descent of the appartus. A release system is provided to simultaneously release the releasable ballast to change the buoyancy of the apparatus to a positive value, release the cable reel to allow cable payout. The cable reel is coupled to a waterbrake system which limits the rate of cable payout to below the rate of ascent of the rescue cable reel. The waterbrake system includes a depth-activated clutch which engages a secondary waterbrake to slow the rate of cable payout near the ocean surface.

19 Claims, 13 Drawing Figures

SUBMARINE RESCUE CABLE REEL

BACKGROUND OF THE INVENTION

The invention relates in general to underwater recovery apparatus and in particular to apparatus for delivering a heavy cable from the ocean bottom to the surface. This invention relates especially to apparatus for delivering a hauldown cable from a distressed submarine to the surface.

Older class submarines were designed to carry rescue buoys as an integral part of their structure. If the submarine became immobilized and unable to surface, the crew of the submarine could release the buoy from inside of the submarine. This buoy would then surface, carrying with it a length of steel cable. One end of the cable was attached to the buoy while the other end was attached to a cable reel on the submarine. The buoy would then be recovered and the cable used to haul down a rescue chamber to the stricken submarine.

Newer class submarines are not equipped with rescue buoys. Instead, they rely entirely on the Deep Submergence Rescue Vehicle (DSRV) for emergencies. However, in case a DSRV is not available, a backup system is required.

SUMMARY OF THE INVENTION

The submarine rescue cable reel (hereinafter referred to as a rescue cable reel) of the present invention is intended primarily to serve as part of a back-up rescue system. Briefly, the back-up rescue system operates as follows during rescue operations. The rescue cable reel loaded with submarine rescue chamber (SRC) cable is carried to the stricken submarine by the manipulator of a deep submergence vehicle (a small submersible such as TURTLE or SEACLIFF). The deep submergence vehicle attaches the bitter end of the cable to the hatch of the stricken submarine and then releases the rescue cable reel which ascends to the surface while paying out the SRC cable. Upon surfacing, the rescue cable reel is recovered and the remaining cable is retrieved and used as the hauldown cable for a submarine rescue chamber. The submarine rescue chamber then winches itself down the downhaul cable to mate with the distressed submarine at the hatch. Finally, the hatch of the submarine is opened, and the crew exits into the rescue chamber which then conveys them to surface.

It is therefore an object of the present invention to provide a means of rescue for distressed submarines without the submarines having to carry rescue buoys.

Another object of the present invention is to provide a means for delivering a heavy lift line from the ocean bottom to the surface in a recovery operation.

A further object of the present invention is to provide a rescue cable reel for delivering a submarine rescue cable from a striken submarine to the surface.

Another object of the present invention is to provide a rescue cable reel capable of being released at great ocean depths.

Yet another object of the present invention is to provide a rescue cable reel having controlled cable payout without compromising any reliability for reaching the surface.

A further object of the present invention is to provide controlled payout while avoiding friction devices which may jam or cause the cable payout to stop prematurely.

Still another object of the present invention is to provide a waterbrake system which controls the rate of cable payout.

A still further object of the present invention is to provide a waterbrake system in which the controlled cable payout rate is further slowed near the surface.

Another object of the present invention is to provide a depth-activated clutch for controlling the cable payout rate.

Still another object of the present invention is to provide a means for releasing the rescue cable reel from the ocean floor suitable for operation by the manipulator arms of a deep submergence vehicle.

A submarine rescue cable reel according to the present invention includes a syntactic foam float providing positive buoyancy for a frame assembly which supports a cable reel holding approximately 1300 feet of submarine rescue chamber cable. Releasable ballasts are included to provide an initial overall buoyancy of a small negative value so that a deep submergence vehicle may carry the rescue cable reel to the stricken submarine. A release system is provided to simultaneously release the releasable ballast to change the buoyancy of the device to a positive value, release the cable reel to allow the cable to payout, and to disengage the deep submergence vehicle from the device. The cable reel is coupled by a positive chain drive to a primary waterbrake which limits the cable payout rate to below the ascent rate of the rescue cable reel. The primary waterbrake is coupled to a secondary waterbrake by a depth-activated clutch which engages the secondary waterbrake to slow the rate of cable payout near the ocean surface.

A direct-acting pin release system is one feature of the present invention. In the release system, a mating pin and a pull pin are mated in an interlocking arangement which is slidable in a collar fixed to the frame assembly. The mating pin is effectively integral with the pull pin as long as the interlocking portions are within the collar. The mating pin (and thus the pull pin) is rigidly coupled to both a ballast release pin from which the releasable ballast is suspended and a reel-locking pin which prevents the cable reel from turning. The same throw distance is required to drop the releasable ballast, free the cable reel, and also remove the interlocking arrangement from the collar. Movement of the pull pin through the prescribed single throw distance, simultaneously disengages the release pin, disengages the reel-locking pin, and removes the interlocking arrangement from the collar so that the pull pin is free to separate from the mating pin.

A waterbrake system is another feature of the present invention in which a first paddle having two curved blades is coupled by a positive chain drive to the cable reel. Rotation of the cable reel as the cable pays out causes the first paddle to be rotated so that the curved blades rotate with the convex side of the curved blades forward. The rotation of the first paddle produces a pumping action which provides a torque on the cable reel opposite in direction to the torque due to the weight of the cable as it pays out, thereby slowing the pay out rate of the cable. A second paddle is coupled to first paddle by a V-belt drive. The tension of the V-belt is controlled by the depth-activated clutch which operates to adjust the tension in the V-belt to couple or decouple the second paddle and the first paddle.

A depth-activated clutch is another feature of the present invention. The top surface of a piston disposed in a vertical cylinder experiences an oil pressure from an oil bladder which is exposed to the ambient sea pressure while the cylinder below the piston contains a compressed gas. The cylinder is initially precharged with the gas to a predetermined pressure with the oil bladder at atmospheric pressure. The piston rod extends upward through the top of the cylinder to rigidly couple to a slide member having an inclined surface and having a vertical slot through which the drive shaft of the secondary waterbrake passes. Movement of the piston in response to changes in the sea pressure applied to the oil bladder is transmitted to the slide member, causing the inclined surface to move along the driveshaft. The motion of the inclined surface is coupled via a pressure plate to the movable half of a split pulley interposed in the driveshaft. Movement of the split pulley changes the tension in a V-belt passing over the pulley to couple or uncouple the driveshaft of the secondary waterbrake from the primary waterbrake.

Other features and advantages of the present invention will be readily appreciated as the subject invention becomes better understood by reference to the following detailed description, when considered in conjunction with the accompanying drawing wherein:

DESCRIPTION OF THE PREFERRED EMBODIMENT

Figure 1:
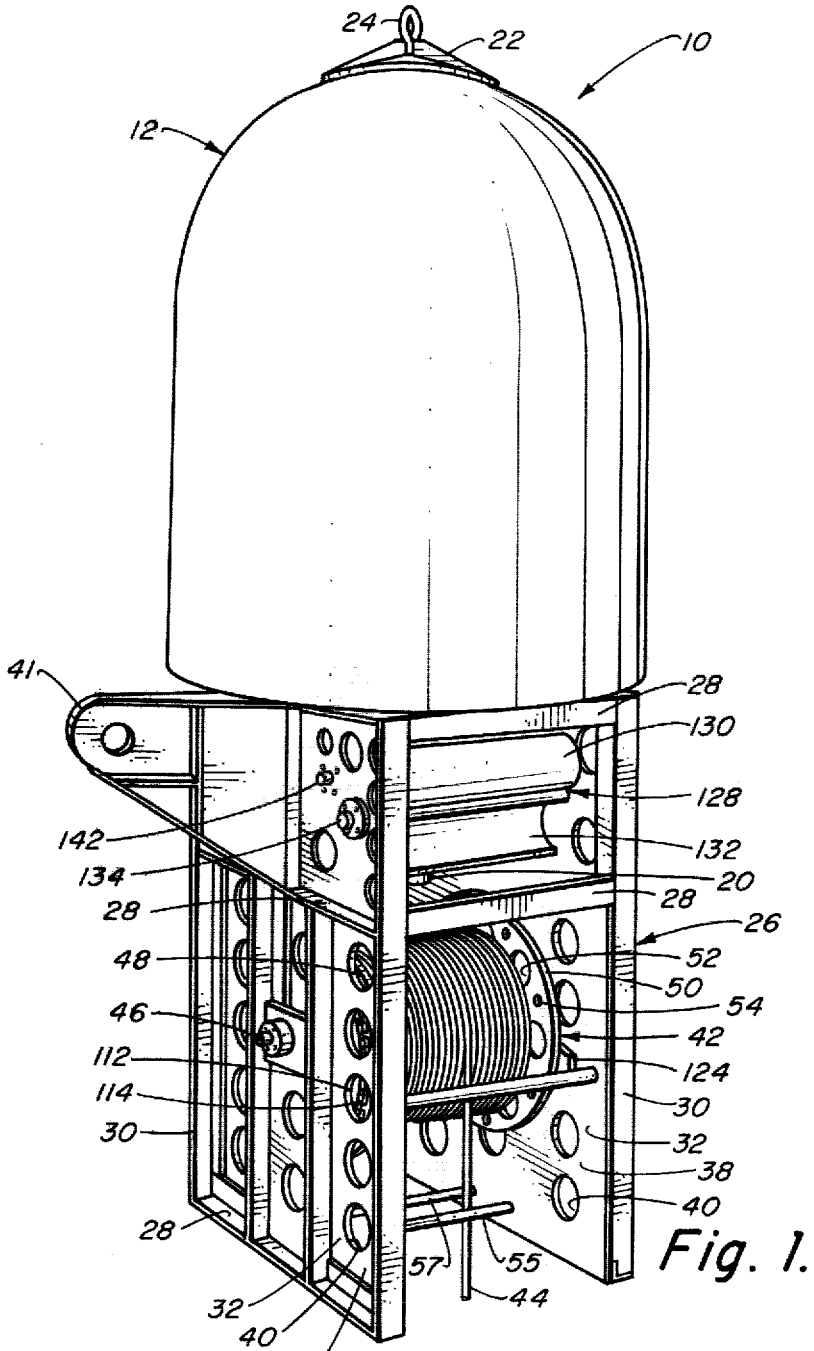
FIG. 1 is an isometric view of the submarine rescue cable reel of the present invention.
Figure 2:
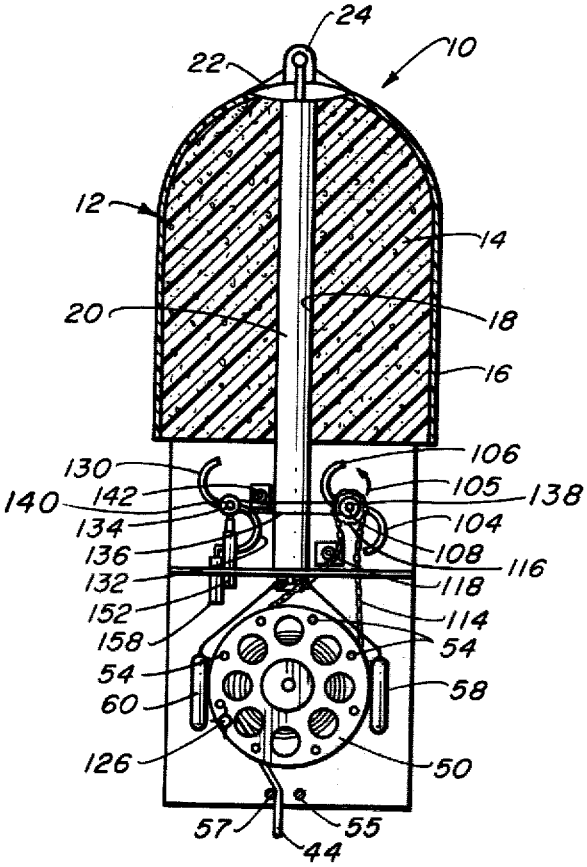
FIG. 2 is a partially schematic, partially broken-away view of the present invention.

Referring now to the drawings in which like reference characters refer to corresponding parts in the several views, and particularly to FIG. 1 and FIG. 2, the rescue cable reel 10 includes a buoyancy float 12 of circular cross-section as its upper section. The buoyancy float 12 is formed of syntactic foam (29 lb/ft$^3$) 14 that will resist damage from the large pressures at the ocean depths. A thin resin shell 16 is formed on the surface of the syntactic foam 14 during the making of the foam float 12. The buoyancy float 12 is provided with a central longitudinal aperture 18 extending from the rounded top of the float to the substantially flat bottom of the float.

An aluminum ballast tube 20 is disposed in the central longitudinal aperture 18. A float cap 22 having a lifting eye 24 is threadably attached to the upper end of the ballast tube, while the ballast tube is rigidly attached near its lower end to a frame assembly 26. The ballast tube 20 provides structural support for the foam float and secures the float to the frame assembly 26. It is noted that the structural components of the preferred embodiment are preferably formed from a strong lightweight material which is corrosion resistant from sea water. Accordingly, anodized or epoxy-coated aluminum is a suitable material for use as the structural components.

Since the rescue cable reel is intended to be carried in the manipulator arms of a deep submergence vehicle to the distressed submarine, the rescue cable reel preferably has a small negative buoyancy (approximately 5–10 lbs) during the intial deployment from the surface to the depth at which the rescue cable is to be delivered. The ballast tube 20 provides a means of adjusting the buoyancy of the rescue cable reel to the proper value. The lower end of the ballast tube 20 is closed so that ballast, typically in the form of lead shot, may be deposited in the tube to adjust the buoyancy of the rescue cable reel. The weight of the rescue cable reel may be adjusted by unscrewing the float cap 22 and adding or removing ballast from the tube 20. The ballast tube 20 may be used to adjust the buoyancy of the rescue cable reel to the proper value when it is initially constructed and also to modify the buoyancy at a later time. For example, the buoyancy of the syntactic foam 12 may be reduced as a result of water absorption or increased by a reduction in volume due to the high pressures experienced during repeated deployments, or the buoyancy of the apparatus may require modification due to a change in weight because of a change in the length of cable carried.

The frame assembly 26 includes a plurality of horizontal aluminum angle irons 28 and vertical aluminum angle irons 30 welded together to form a rigid rectangular cage. Rigid aluminum plates 32 are affixed to the angle irons by bolts (not shown for simplicity) to form two side walls 36 and 38 of the frame assembly 26. The rigid plates 32 have circular apertures 40 cut in them to decrease the weight of the frame assembly and to allow water to flow through the side walls 36 and 38. A bracket 41 is provided to allow the rescue cable reel to be carried by a deep submergence vehicle.

A cable reel 42, which is designed to hold 1300 feet of 7/16" diameter 6×37 steel wire cable 44 on its spool, is disposed within the lower portion of the frame assembly 26 between the side walls 36 and 38. The cable reel 42 is mounted in maintenance-free Teflon fiber epoxy bearing blocks 46 so that the cable reel is free to rotate about its axis. The flanges 48 and 50 of the cable reel have symmetrically placed apertures 52 to reduce the weight of the reel. Flange 50 also has a plurality of locking holes 54 disposed periodically near its outer periphery for receiving a reel-locking pin 56. (See FIG. 3). The reel-locking pin 56 extends through the side wall 38 into the flange 50 to secure the cable reel to the frame assembly and prevent it from turning until the pin is removed. The reel-locking pin 56 will be discussed more fully hereinafter in connection with the rescue cable reel release system.

Horizontal bars 55 and 57 are mounted between the sidewalls 36 and 38 near the base of the frame assembly 26 to provide a cable yoke to ensure smooth payout of the cable 44.

As noted earlier, rescue cable reel requires a negative buoyancy of approximately 5–10 lbs so that the rescue cable reel may be carried by the manipulator arms of a deep submergence vehicle to the distressed submarine. After the rescue cable reel has been deposited on the ocean floor or the deck of the submarine and the bitter end of the rescue cable 44 attached to the submarine hatch, the rescue cable reel must become positively buoyant and the cable reel must become free to rotate so that the rescue cable reel may ascend to the surface.

Figure 3:
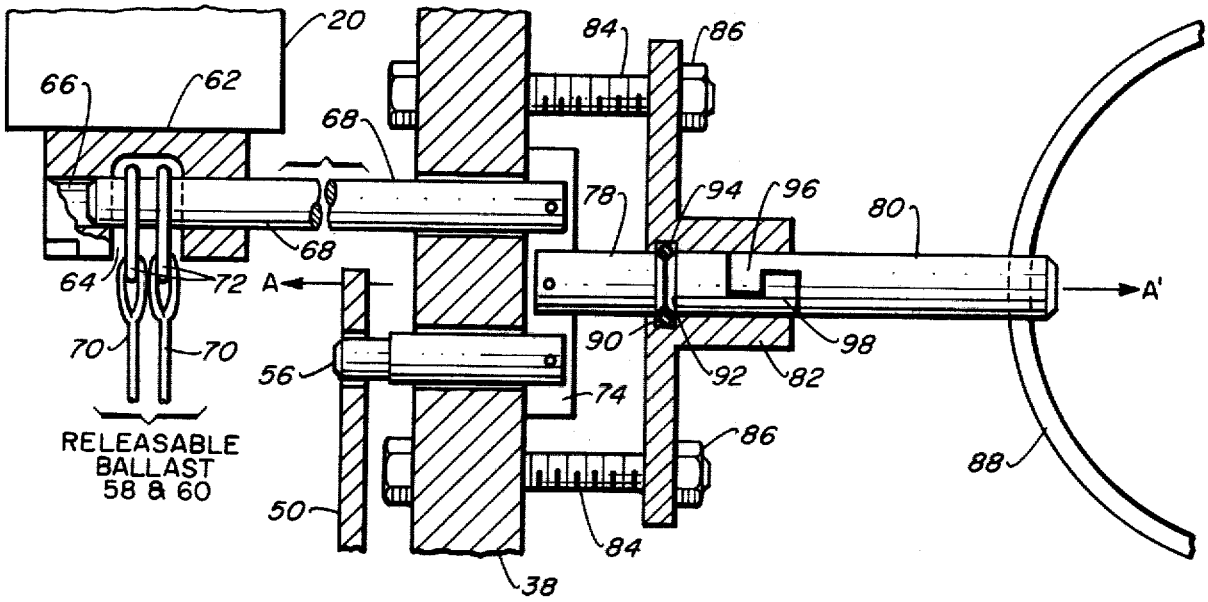
FIG. 3 is a cross-sectional view of the pin release system of the present invention.
Figure 4A:
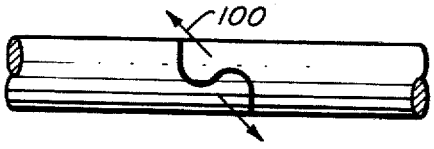
FIGS. 4*a*–4*d* show alternate geometries for the interlocking surfaces of the mating pin and the pull pin.
Figure 4B:
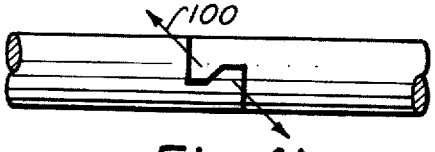
Figure 4C:
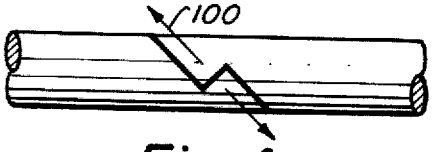
Figure 4D:
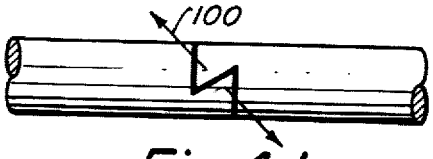

Two releasable ballasts 58 and 60 (not shown in FIG. 1) are provided for altering the buoyancy of the rescue cable reel so that it may rise to the surface. The releasable ballasts 58 and 60 are suspended from an aluminum block 62 which is bolted to the closed lower end of the ballast tube above the cable reel 42. As best shown in FIG. 3, the block has a horizontal channel 64 oriented in a direction normal to the axis of rotation of the cable reel 42 and a horizontal bore 66 in a direction parallel to the axis of rotation of the cable reel. A release pin 68, inserted through an aperture in the side wall 38 of the frame 26, passes through the bore 66. The releasable ballasts 58 and 60 are attached by a length of rope 70 to lifting eyes 72. The ballasts 58 and 60 are suspended by passing the release pin through the lifting eyes 72 while the lifting eyes are in the channel so that the ballasts are supported by the release pin and hang free, resting against the cable as it is wrapped on the reel as shown in FIG. 2.

The release system of the present invention is the subject of the co-pending U.S. Patent Application Ser. No. 055,923, now U.S. Pat. No. 4,211,502 issued July 8, 1980, which is hereby incorporated by reference herein. The release system illustrated in FIG. 3 allows a single pull by the manipulator of a deep submergence vehicle to simultaneously release the releasable ballast 48 and 60, free the cable reel 42 for rotation, and disengage the manipulator from the rescue cable reel. The reel-locking pin 56 and the release pin 68 after passing through sidewall 38 are rigidly joined together by bar 74. The bar 74 is rigidly attached to a breakaway pin. The breakaway pin, which comprises a mating pin 78 and a pull pin 80 passes through a collar 82 which is fixed to the sidewall 38 by bolts 84 and nuts 86. The mating pin 78 and the pull pin 80 are adapted to mate within the collar to form, in the unreleased condition, an interlocking arrangement as shown. A pull ring 88 which may be grasped by a deep submergence vehicle manipulator is attached to the pull pin 80.

The collar has an annular channel 90 which is aligned with an annular groove 92 in the mating pin 78 when the breakaway pin 76 is in the engaged position. An O-ring 94 is disposed within an annular cavity formed by the annular channel 90 and annular groove 92. This arrangement applies frictional loads to the mating pin 78 (and thus the ballast release pin 68 and the reel-locking pin 56) to prevent the pin from accidentally returning to the unreleased position after it has been released or the pulling force is removed.

The release is unactuated as long as the interlocking surfaces of the mating pin 78 and the pull pin 80 are contained within the collar 82. When the mating pin 78 and the pull pin 80 are mated within the collar 82, the pull pin 80 is effectively an integral part of the mating pin 78. The breakaway pin release is actuated by pulling on the pull pin 80 in the direction A—A' which results in movement of ballast release pin 68 and reel-locking pin 56 which disengages the pins from the lifting eyes 72 and the cable reel flange 50, respectively. At the same time as the pins 56 and 68 are disengaged, the interlocking mechanism is pulled out of the collar 82 so that the interlocking (mating) surfaces are not confined and are therefore free to separate. Thus, two releases are accomplished with a single throw, after which the pull pin 80 is free to breakaway, freeing the pull pin and the pulling mechanism (such as a manipulator) from the released assembly.

FIGS. 4*a*–4*d* illustrate alternate geometries for the interlocking surfaces 96 and 98 of the mating pin 78 and the pull pin 80. Obviously many other geometries are possible, however, it is noted that a geometry in which the interlocking surfaces are parallel to or normal to the direction of pull on the pull pin 80 as shown in FIG. 3. is preferred since geometries such as shown in FIGS. 4*a*–4*d* produce normally unwanted side loading in the directions shown by the arrows 100.

After the cable reel 42 and the releasable ballast have been released, the rescue cable reel begins to ascend to the surface while paying out the SRC cable 44. However, the weight of the steel cable 44 will cause the cable to pay off the reel 42 (i.e. unwind) faster than the apparatus can ascend to the surface. This condition will result in slack cable piling up on the seafloor (or the submarine) and producing a degree of unreliability in the rescue cable reel reaching the surface. To prevent this possibility, the rescue cable reel includes a primary waterbrake assembly to govern the payout speed of the SRC cable. Referring to FIGS. 1, 2 and 8, primary waterbrake assembly includes a paddle having two curved blades 104 and 106 attached to a driveshaft 108. The paddle is mounted between the sidewalls 36 and 38 on journal bearings above the cable reel 42 as shown. The paddle is connected by a positive chain drive to the cable reel 42. A large sprocket 112 fixed to the axle of the cable reel 42, is coupled by a drive chain 114 to a small sprocket 116 fixed to the driveshaft 108 of the primary waterbrake paddle to provide a positive drive between the cable reel and the primary waterbrake. An idler sprocket 118 mounted on sidewall 36 is provided to adjust the tension in the drive chain 114.

The drive chain is coupled so that rotation of the cable reel 42 causes the paddle to rotate in the direction indicated by arrow 105. That is, the paddle is rotated so that the curved blades 104 and 106 present a convex surface to the water. This direction of rotation causes the waterbrake to pump water out of the frame assembly 26. The pumping force on the rotating paddle is directly proportional to the square of its speed, and to the torque on the cable reel 42. Thus the waterbrake is ideally suited as a speed governor for the cable reel 42. The faster the cable 44 pays out, the faster the waterbrake pumps, counteracting the torque produced by the unspooling cable and thus slowing the rate of payout.

A secondary waterbrake is included in the rescue cable reel to provide additional slowing of cable payout as the rescue cable reel nears the surface. Surface swimmers can then manually lock the cable reel 42 by means of a handbrake leaving only a minimum amount of slack cable on the seafloor. The handbrake which is mounted in the sidewall 38 applies an asbestos brake pad 124 (see FIG. 1) to the outer periphery of the cable reel flange 50 by a screw-type action when the manual control knob 126 is turned. The secondary waterbrake is identical in appearance to the primary waterbrake and includes a paddle 128 having curved blades 130 and 132 which is mounted between sidewalls 36 and 38 on journal bearings. The driveshaft 134 of the secondary waterbrake is coupled to the driveshaft of the primary waterbrake by a V-belt 136 between a standard V-belt pulley 138 on the driveshaft of the primary waterbrake and a split pulley 140 on the driveshaft of the secondary waterbrake. A depth activated clutch as will be described hereinafter controls the tension in the V-belt so that the secondary waterbrake is free wheeling except when the clutch causes the secondary waterbrake to directly couple to the primary waterbrake by increasing the tension in the V-belt 136. An idler pulley 142 is provided for minor adjustments in the tension of the V-belt.

Figure 5B:
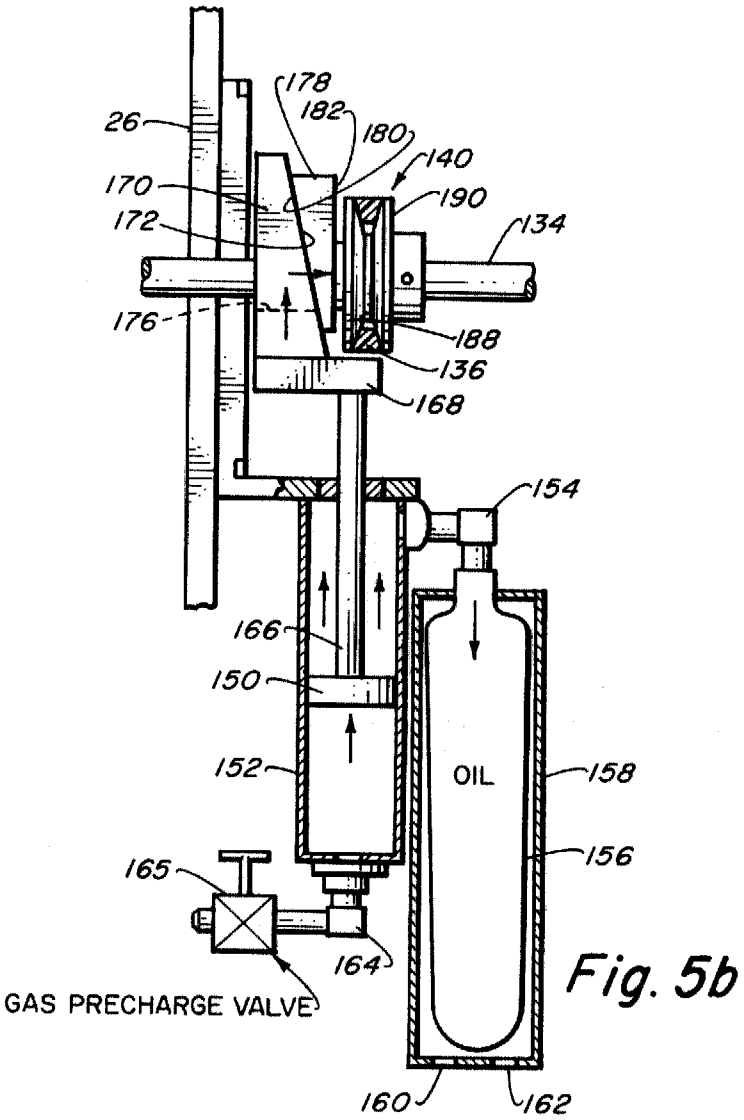
FIGS. 5*a* and 5*b* are partially cross-sectional views illustrating the depth-activated clutch.
Figure 5A:
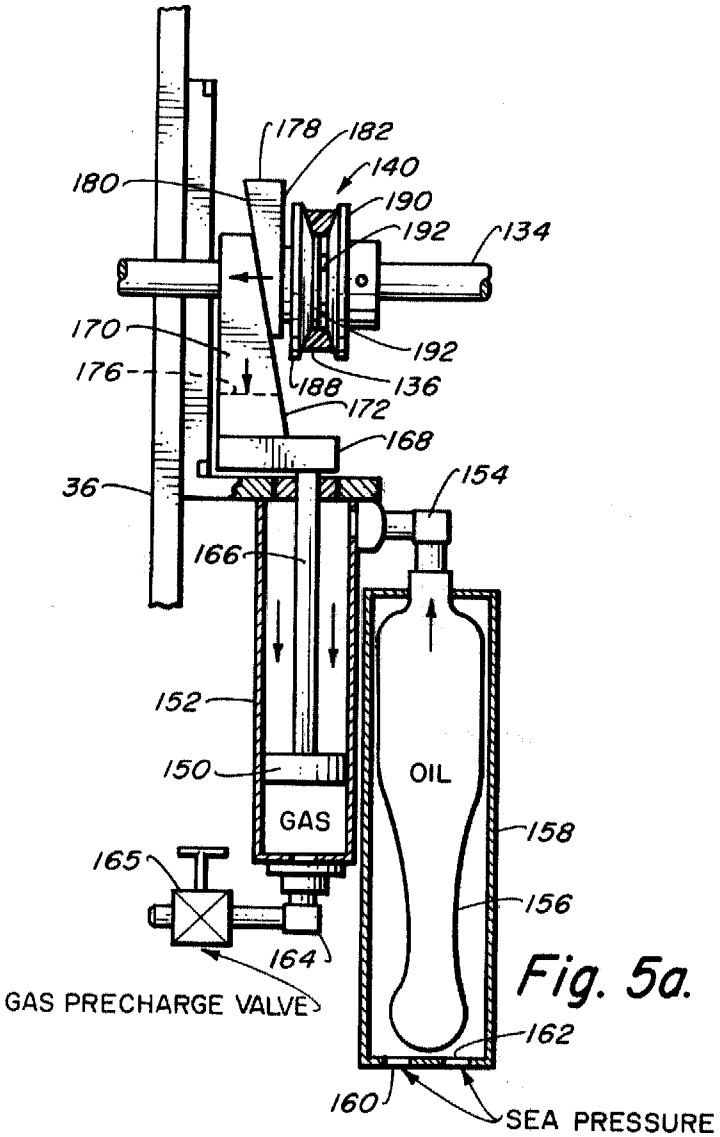

Referring now to FIGS. 5*a* and 5*b*, the depth-activated clutch includes a piston 150 disposed in a vertical cylinder 152 which is rigidly affixed to side wall 36. The top surface of the piston experiences an oil pressure from an oil reservoir related to the ambient sea pressure while the bottom surface of the piston experiences a predetermined gas pressure. The top of the cylinder 152 communicates by suitable conduit 154 to an oil bladder 156. The bladder 156 is confined in a housing 158 which has apertures 160 and 162 in its base to expose the bladder to the ambient sea pressure. The oil in the bladder is therefore pressurized at the ambient sea pressure and this pressure is applied to the top surface of the piston 150. The bottom of the cylinder 152 communicates by suitable conduit 164 with a gas precharge valve 165 so that the gas pressure in the cylinder below the piston 150 may be charged to a predetermined value. In the preferred embodiment, the cylinder is precharged (prior to deployment) with nitrogen gas while the oil bladder 156 is at atmospheric pressure.

The piston rod 166 extends upward through the top of the cylinder 152 and is threadably coupled to the horizontal base 168 of a slide member 170. The slide member 170 is an L-shaped member having an inclined surface 172 and a vertical slot extending from its top downward to dashed line 176. The drive shaft 134 of the secondary water brake extends through the slot. A pressure plate 178, having an inclined surface 180 complementary to the inclined surface 172 and a vertical surface 182, is supported by the drive shaft 134 which passes through a central aperture in the pressure plate. Upward motion of the slide member 168 causes the pressure plate 178 to slide to the right on the driveshaft 134 and downward motion of the slide member allows the pressure plate to slide to the left as indicated by arrows in FIGS. 5*a* and 5*b*.

The vertical surface 182 of the pressure plate 178 abuts the split pulley 140 which is interposed in the drive shaft 134. The split pulley has a left side 188 abutting the pressure plate 178 coupled to a right side 190 by locating pins 192. The left side of the pulley is free to move along the axis of the drive shaft 134 in response to motion of the pressure plate. The V-belt 136 couples the split pulley 140 to the driveshaft of the primary waterbrake.

The depth-activated clutch operates as follows to engage or disengage the secondary waterbrake. Prior launch deployment of the rescue cable reel 10, the cylinder 152 is charged with nitrogen gas at a predetermined pressure via the gas precharge valve 165 and conduit 164. As precharging occurs, the upper surface of the piston 150 experiences an oil pressure equal to the atmospheric pressure since oil bladder 156 is exposed to the ambient pressure through aperture 160 and 162 of the bladder housing 158. The pressure differential between the lower surface and the upper surface of the piston 150 (the precharge pressure on the lower surface and atmospheric pressure on the upper surface), causes the piston to be driven upward. This upward motion expels oil from the cylinder until the oil bladder is fully extended by the uncompressible fluid and an equilibrium position is established as shown in FIG. 5*b* with the precharge pressure on each side of the piston.

The upward motion by the piston 150 is coupled to the slide member 170 by the piston rod 166. As the slide member 170 moves upward, the interface between the inclined surface 172 of the slide member and the inclined surface 180 of the pressure plate 178 moves to the right, the pressure plate sliding on the drive shaft 134. As the pressure plate 178 slides to the right, the left half 188 of the split pulley 140 is driven to the right over locating pins 192 to abut with the right half 190. As the halves of the split pulley 140 come together, the tension in V-belt 136 is increased, coupling the split pulley 140 attached to drive shaft 134 of the secondary waterbrake to the standard pulley 138 attached to the drive shaft 108 of the primary waterbrake, thereby coupling the secondary and primary waterbrake.

When the rescue cable reel 10 is deployed, the sea pressure on the oil bladder 156 increases as the assembly descends in the ocean, causing the pressure on the top surface of the piston 150 to increase. As the pressure on the top of the piston 150 becomes greater than the precharge gas pressure, the piston is forced downward compressing the gas below the piston while maintaining an equilibrium. The downward movement of the piston 150 produces a downward movement of the slide member 170 which moves the inclined surface 172 to the left. The pressure plate 178 is then free to slide to the left on the drive shaft 134 which allows the left half 188 of the split pulley 140 to slide on locating pins 192 due to pressure from the V-belt 136. The V-belt 136 may then drop into the pulley channel as shown in FIG. 5*a* thereby decreasing the tension of the V-belt and decoupling the secondary waterbrake from the primary waterbrake.

The operation of the depth-activated clutch during ascent from the ocean depths to the surface is the reverse of the operation during descent. As the clutch ascends, the sea pressure on the bladder decreases, causing oil pressure on the top of the piston 150 to decrease. The gas pressure below the piston 150 forces the piston upward while maintaining equilibrium between the gas pressure and oil pressure. The upward motion of the piston 150 is coupled by the piston rod 166 to the slide member 170 to produce a movement to the right by the pressure plate 178. The movement to the right by the pressure plate 178 forces the left half 188 of the split pulley 140 toward the right half 190 of the split pulley, thereby narrowing the channel formed by the pulley 186 and increasing the tension in the V-belt.

Figure 6:
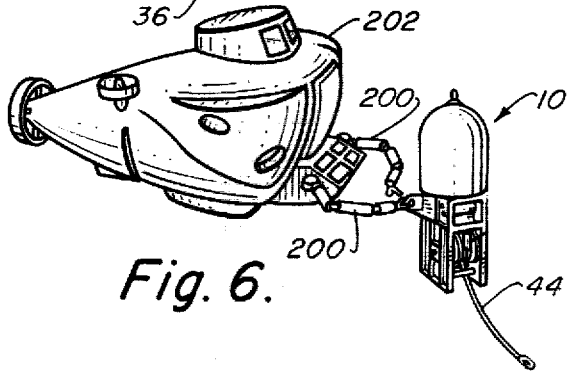
FIG. 6 is a pictorial illustration of a deep submersible vehicle carrying the rescue cable reel.

In operation, the rescue cable reel 10, loaded with the rescue cable, is carried in the manipulator arms 200 of a deep submergence vehicle 202 as shown in FIG. 6 to the striken submarine. As discussed hereinbefore, the rescue cable reel 10, including the releasable ballasts 58 and 60 and the lead shot in the ballast tube 20, should preferably weigh 5 to 10 pounds in water. This small negative buoyancy permits the rescue cable reel to be easily carried by the deep submergence vehicle and to rest on the ocean bottom or the deck of the distressed submarine. With the rescue cable reel 10 resting on the bottom or deck, the operator of the deep submergence vehicle attaches the bitter end of the rescue cable 44 to the hatch of the submarine using the manipulator arms.

After attaching the rescue cable 44, the deep submergence vehicle releases the rescue cable reel 10, activating the release system (as discussed in connection with FIG. 3) by pulling on the manipulator ring 88. This simultaneously releases the releasable ballasts 58 and 60 and the cable reel 42 by disengaging the ballast release pin 68 from the lifting eyes 72 and the reel-locking pin 56 from the cable reel flange 50. The pull pin 80 is simultaneously released from the rescue cable reel 10 as the interlocking surfaces 96 and 98 are pulled free from the collar 82. The deep submergence vehicle is thereby disconnected from the rescue cable reel 10 which begins a free ascent to the surface.

In order to produce an appropriate ascent rate, the net ascent buoyancy of the rescue cable reel 10 should be at least 90 pounds. In the operative embodiment each releasable ballast 58 and 60 is a lead bar weighing 56 pounds in air.

Figure 7:
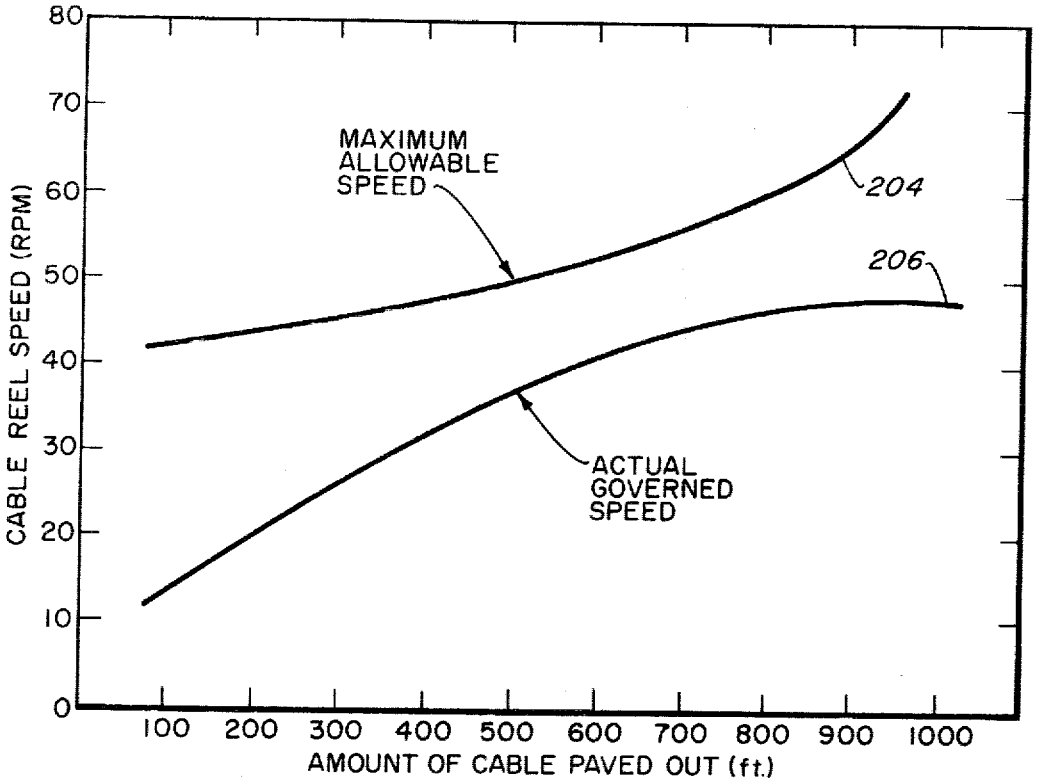
FIG. 7 is a graph showing the performance of the primary waterbrake in controlling the cable payout speed.
Figure 8A:
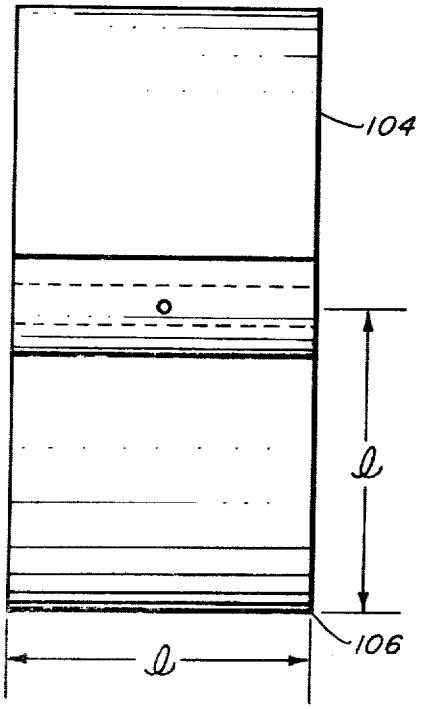
FIGS. 8*a* and 8*b* illustrate the paddles used in the waterbrake.
Figure 8B:
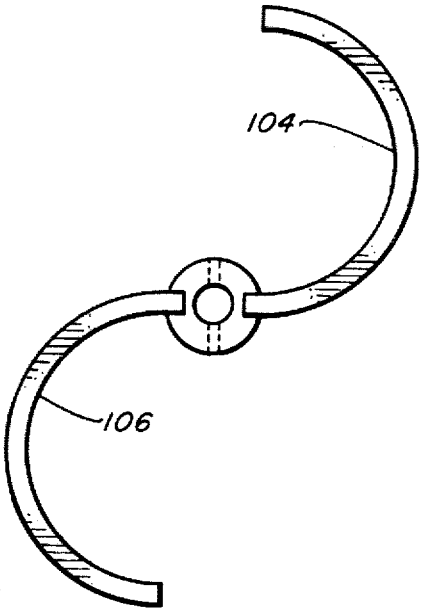

As the rescue cable ascends toward the surface due to the increased buoyancy, the cable 40 pays off the cable reel 42 at a rate limited by the primary waterbrake assembly in the manner described hereinbefore. The size of the primary waterbrake assembly and the ratio between large sprocket 112 and small sprocket 116 is determined by the free-ascent rate of the rescue cable reel because the primary waterbrake must limit the payout speed of the cable below the free-ascent rate. In designing the operative embodiment, the free-ascent rate was measured to be 3.26 feet per second permitting a maximum cable reel payout speed in revolution per minute versus amount of cable payed out as shown by curve 204 in FIG. 7. Curve 206 shows the actual governed speed for a primary waterbrake having for a sprocket ratio of 10:1 between large sprocket 112 and small sprocket 116 and a paddle 102 having the dimensions as shown in FIGS. 8*a* and 8*b*, where curved blades 104 and 106 are semi-circular in shape with radii, r, of 2.5 inches and lengths, 1, of 5 inches.

As the rescue cable reel 10 nears the surface, the secondary waterbrake provides additional slowing of cable payouts. Once engaged, the secondary waterbrake functions in the same manner as the primary waterbrake. The depth-activated clutch couples the secondary waterbrake to the primary waterbrake in the manner previously described at a depth determined by the precharge gas pressure of cylinder 152.

When the rescue cable reel 10 reaches the surface, surface swimmers can manually lock the cable reel 42 with the handbrake to prevent additional cable from paying out and creating slack cable which may pile up on the ocean floor. A lift line is then attached to the lifting eye 22 and the rescue cable reel 10 is recovered aboard a support vessel. It is noted that once the waterbrakes are out of the water, the only brake preventing the cable 44 from paying off the reel 42 is the manual handbrake. The rescue cable 44 is now cut and connected to the downhaul reel of the submarine rescue chamber.

Obviously, many modifications and variations of the present invention are possible in the light of the above teachings. It is therefore to be understood that within the scope of the appended claims the invention may be practiced otherwise than as specifically described.

What is claimed is:

1. Apparatus for delivering a cable having a first end fixed to an object at an extended depth to the ocean's surface comprising:

a. a frame assembly;

b. a cable reel rotatably mounted in said frame assembly, said cable reel holding the cable to be delivered to the surface;

c. means for locking said cable reel to prevent said cable reel from rotating;

d. positive buoyancy means attached to said frame assembly;

e. means for releasing said means for locking to allow said cable reel to rotate;

f. means for controlling the speed at which said cable is payed out as the apparatus ascends to the surface comprising a waterbrake coupled for providing torque to the cable reel, the torque provided by said waterbrake being opposite in direction to the torque provided by said cable; said waterbrake including:

a first paddle having at least one blade and having a drive shaft rotatably mounted in said frame assembly;

a first drive wheel mounted on said drive shaft of said first paddle;

a second drive wheel coupled to said cable reel for rotation therewith;

a drive means positively coupling said first and second drive wheels so that rotation of the cable reel produces a rotation of the first paddle, the resistance of the water to the rotation of the first paddle providing the torque opposite in direction of the torque on the cable reel due to the cable;

said at least one blade being curved so that the convex surface of said blade pushes against the water when the cable reel rotates as the cable pays out;

a second paddle having at least one blade and having a drive shaft rotatably mounted in said frame assembly;

a V-belt pulley mounted on the drive shaft of said first paddle;

a split pulley of the V-belt type having a movable half which is free to move along the axis of and interposed in the drive shaft of said second paddle;

a V-belt passing over said V-belt pulley and said split pulley; and depth-activated means for controlling the position of the movable half of said split pulley to change the tension in said V-belt to couple or uncouple the drive shaft of the second paddle from the drive shaft of the first paddle.

2. Apparatus as recited in claim 1 wherein said at least one blade of said second paddle is curved so that the convex surfaces of said blade pushes against the water when the cable reel rotates as the cable pays out.

3. Apparatus as recited in claim 1 wherein said means for locking said cable reel includes:

a reel-locking pin; and wherein said cable reel has an aperture in its flange for receiving said reel-locking pin; and said frame assembly has an aperture for receiving said reel-locking pin, said reel-locking pin passing through said aperture in the frame assembly and the aperture in the cable reel flange to prevent said cable reel from rotating relative to said frame assembly.

4. Apparatus as recited in claim 3 wherein said means for releasing said means for locking comprises a breakaway pin release including:

a collar having a bore therein, said collar being fixed to said frame assembly, a mating pin rigidly coupled to said reel-locking pin, said mating pin having a mating portion adapted for interlocking with another pin within said collar;

a pull pin having a first end adapted to be pulled and a mating portion adapted for interlocking with the mating portion of the mating pin, said mating pin and said pull pin slidable as a unit through said collar as long as the mating portions of said mating pin and said pull pin are interlocked within said collar, said pull pin being free to separate from said mating pin when said mating portions are not within said collar.

5. Apparatus as recited in claim 4 wherein the interlocking surfaces of said mating portions of said mating pin and said pull pin are oriented parallel to or normal to the longitudinal axis of said pins, said orientation producing no frictional side loads when said interlocked pins are pulled in a direction parallel to said longitudinal axis.

6. The apparatus as recited in claim 1 wherein said depth-activated means comprises a clutch including:

a cylinder;

a piston disposed in said cylinder;

means for applying a fluid pressure corresponding to the pressure of the external environment to a first side of said piston in said cylinder;

means for filling the cylinder with a gas to establish a predetermined pressure on the other side of said piston;

a slide member rigidly coupled to said piston and disposed about the drive shaft of said second paddle so that motion by said piston in said cylinder produces motion of said slide member along the drive shaft of said second paddle, the movable side of said split pulley free to move along said drive shaft in response to motion by said slide member, the movement of said movable side changing the tension in the V-belt passing over said pulley.

7. Apparatus recited in claim 6 wherein said means for applying fluid pressure corresponding to the pressure of the external environment to one side of said piston in said cylinder includes:

a fluid containing bladder exposed to the external environment and communicating with said cylinder on said first side of said piston.

8. Apparatus as recited in claim 7 wherein said fluid containing bladder is surrounded by a protective housing said housing having openings for exposing said bladder to the ambient environment.

9. Apparatus as recited in claim 8 wherein said means for filling the cylinder with a gas includes:

a gas precharge valve in communication with said cylinder of said other side of the piston.

10. Apparatus as recited in claim 1 wherein said positive buoyancy means includes a float of syntactic foam mounted on said frame assembly.

11. Apparatus as recited in claim 10 wherein said float has a longitudinal aperture; and further including a rigid tube disposed in said aperture for providing structural support for said float and for receiving ballast to adjust the buoyancy of the apparatus.

12. The apparatus as recited in claim 1 wherein said depth-activated means comprises a clutch including:

an upright cylinder fixed to said frame assembly;

a piston disposed in said cylinder;

means for applying a fluid pressure corresponding to the pressure of the external environment to the top side of said piston in said cylinder;

means for filling the cylinder with a gas to establish a predetermined presure on the bottom side of the piston;

a slide member having an inclined surface rigidly coupled to said piston, said slide member disposed about the drive shaft of said second paddle so that vertical motion by said piston in said cylinder produces horizontal motion of said inclined surface along the axis of said drive shaft;

a pressure plate having an inclined surface complementary to the inclined surface of said slide member, a vertical surface opposite its inclined surface, and an aperture through which said drive shaft passes so that said pressure plate is free to slide along the drive shaft of said second paddle, said pressure plate disposed so that its inclined surface is opposed to the inclined surface of said slide member whereby horizontal motion of the inclined motion of said slide member along said drive shaft produces a horizontal motion of the vertical surface of said pressure plate along said drive shaft, the position of said pressure plate determining the position of the movable side of said split pulley to control the tension in said V-belt.

13. Apparatus as recited in claim 1 wherein said first and second drive wheels of said waterbrake are sprocket wheels and said drive means is a drive chain.

14. Apparatus as recited in claim 1 including:

releasable ballast means attached to said frame assembly for providing a negative resultant buoyancy for said apparatus, the resultant buoyancy being positive when said releasable ballast is not attached to said frame assembly; and means for releasing said releasable ballast means from said frame assembly.

15. Apparatus as recited in claim 14 wherein said means for releasing said releasable ballast means and means for releasing said means for locking includes:

a collar having a bore therein, said collar being fixed to said frame assembly, a mating pin rigidly coupled to said reel-locking means and to said ballast release pin, said mating pin having a mating portion adapted for interlocking with another pin within said collar;

a pull pin having a first end adapted to be pulled and a mating portion adapted for interlocking with the mating portion of the mating pin, said mating pin and said pull pin slidable as a unit through said collar as long as the mating portions of said mating pin and said pull pin are interlocked within said collar, said pull pin being free to separate from said mating pin when said mating portions are not within said collar.

16. Apparatus as recited in claim 15 wherein the interlocking surfaces of said mating portions of said mating pin and said pull pin are oriented parallel to or normal to the longitudinal axis of said pin, said orientation producing no frictional side loads when said interlocked pins are pulled in a direction parallel to said longitudinal axis.

17. Apparatus as recited in claim 14 wherein said releasable ballast means includes:

ballast means;

lifting eye means coupled to said ballast; and means for suspending said ballast means from said frame assembly, said means for suspending including a support block having a horizontal channel and a horizontal bore, said channel and bore being perpendicular, and a ballast release pin, the ballast release pin being disposed in said bore through said channel, the lifting eye means being suspended from said release pin in said channel.

18. Apparatus as in claim 1 wherein said second paddle has at least one blade which provides a torque opposite in direction to the torque on the cable reel due to the cable.

19. Apparatus as in claim 1 wherein said depth-activated means comprises a clutch for coupling said second paddle to said first paddle above a predetermined depth and uncoupling said first paddle and said second paddle below said predetermined depth.

* * * * *